US005316408A

United States Patent [19]

Stanley et al.

[11] Patent Number: 5,316,408

[45] Date of Patent: * May 31, 1994

[54] BOARD MAT CONSTRUCTION

[75] Inventors: T. K. Stanley, Shubuta; Cary S. Farrar, Waynesboro, both of Miss.

[73] Assignee: T. K. Stanley Incorporated, Waynesboro, Miss.

[ * ] Notice: The portion of the term of this patent subsequent to Apr. 13, 2010 has been disclaimed.

[21] Appl. No.: 989,643

[22] Filed: Dec. 11, 1992

Related U.S. Application Data

[63] Continuation-in-part of Ser. No. 760,917, Sep. 17, 1991, Pat. No. 5,201,601.

[51] Int. Cl.[5] ..... E01C 5/16; E01C 9/08

[52] U.S. Cl. ..... 404/35; 15/215; 238/14

[58] Field of Search ..... 404/34-36, 404/17, 46, 18, 29; 244/114; 272/3, 56.5; 52/603, 660, 575; 428/44; 238/14, 10 R

[56] References Cited

U.S. PATENT DOCUMENTS

| | | | |
|---|---|---|---|
| 1,970,037 | 8/1934 | Fischer | 94/3 |
| 2,639,650 | 5/1953 | Robishaw | 94/13 |
| 2,652,753 | 9/1953 | Smith | 94/13 |
| 2,819,026 | 1/1958 | Leyendecker | 238/10 |
| 2,912,909 | 11/1959 | Hart | 94/11 |
| 4,289,420 | 9/1981 | Davis et al. | 404/35 |
| 4,462,712 | 7/1984 | Penland, Sr. | 404/36 |
| 4,600,336 | 7/1986 | Waller, Jr. | 404/41 |
| 4,875,800 | 10/1989 | Hicks | 404/35 |
| 4,889,444 | 12/1989 | Pouyer | 404/34 |
| 5,020,937 | 6/1991 | Pouyer | 404/35 |
| 5,032,037 | 7/1991 | Phillips et al. | 404/35 X |
| 5,087,149 | 2/1992 | Waller, Jr. | 404/35 |
| 5,163,776 | 11/1992 | Pouyer | 404/35 X |

OTHER PUBLICATIONS

Uni-Mat International, Inc.

*Primary Examiner*—Kenneth J. Dorner
*Assistant Examiner*—Nancy Mulcare
*Attorney, Agent, or Firm*—Jacobson, Price, Holman & Stern

[57] ABSTRACT

A roadway/platform mat construction is provided for disposition over soft ground. The mat construction includes a rectangular, panel-like mat structure including opposite transverse end margins and opposite side longitudinal margins. The mat construction defines a first rectangular surface and a second rectangular surface facing opposite and paralleling the first surface and including elongated transverse members carried by the opposite ends of the mat structure and projecting outwardly of the second surface thereof. The transverse members are of a length measured longitudinally of the mat construction equal to substantially one-quarter the length of the overall mat structure and the spacing between opposite end members of each mat structure measured longitudinally thereof is equal to substantially one-half the length of the mat structure.

24 Claims, 3 Drawing Sheets

BOARD MAT CONSTRUCTION

CROSS-REFERENCE TO RELATED APPLICATIONS

This application is a continuation-in-part of application Ser. No. 07/760,917 now U.S. Pat. No. 5,201,601 for Board Mat Construction, filed Sep. 17, 1991.

BACKGROUND OF THE INVENTION

1. Field of the Invention

This invention relates to mat structures to be constructed preferably of wood or wood products and a temporary roadway or platform lying upon soft ground formed from such mat structures.

2. Description of Related Art

Various different forms of board mat constructions heretofore have been provided such as those disclosed in U.S. Pat. Nos: 1,970,037, 2,639,650, 2,652,753, 2,819,026, 2,912,909, 4,289,420, 4,462,712, 4,600,336, 4,875,800, 4,889,444 and 5,020,937. However, these various different forms of mat constructions, in many instances, do not provide sufficient ground traction between the mat constructions and the underlying ground surface and between the upper surface of the mat construction and a vehicle moving thereover. Furthermore, these previously known mat constructions may not be readily mass produced at low cost and the spacing of multiple transverse boards thereof spaced along the length of the mat require relatively precise spacing jigs in order to effect mass production. In addition, many of these previously known forms of mat constructions require extensive cleaning after each usage on soft ground and are difficult to correctly assemble when laying down a mat construction.

SUMMARY OF THE INVENTION

The mat construction of the instant invention, basically, includes a rectangular planar surface defining member and a pair of transverse member structures, which may be formed from logs or boards, secured to and extending transversely at the opposite ends of the surface defining member. The transverse members, or panels, form edge surfaces substantially perpendicular to the planar surface member. These edge surfaces are located at opposite ends of the mat and at locations slightly less than approximately one-quarter the length of the mat from each mat end.

When forming a roadway or platform, a plurality of mat constructions or structures are disposed with their surface defining member uppermost and their transverse members lowermost. Other mat constructions of the roadway or platform are inverted and disposed beneath the first mentioned mat constructions.

The mat constructions or structures may all be of the same length and width and the transverse members each have a length, i.e. the dimension along the length or major axis of the mat structure, slightly less than one-quarter the length of the planar surface defining member. The transverse members, or panels, are spaced apart to define an open space therebetween slightly greater than one-half the length of the planar surface defining member.

The inverted mat constructions, or structures, with the surface defining member lowermost and the transverse members uppermost are first laid upon the ground lengthwise in end-to-end aligned relation. The uppermost mat structures are then disposed over the inverted mat structures with the spacing between the transverse members of each of the upper mat constructions receiving therein the adjacent transverse members of adjacent ends of the inverted mat structures. The spacing between the transverse members of each lower mat construction receive therein the adjacent transverse end members of adjacent ends of the upper mat structures.

A main object of this invention is to provide a mat construction for use in forming a roadway or platform on soft ground with a minimum amount of expense, transportation costs, difficulty in assembling the individual mat constructions in order to form a roadway or platform, and ease of removal of the mat constructions after usage and cleaning thereof prior to subsequent usage.

Another object of this invention is to provide a mat construction in accordance with the preceding objects which will afford ground traction between the lower mat constructions and the ground upon which they are disposed.

Another object of this invention is to provide mat constructions formed in a manner such that surface traction of the upper mat constructions of a roadway or platform being with the wheels of vehicles traveling thereover may be increased.

Another very important object of this invention is to provide a mat construction which may be produced at low cost.

Still another object of this invention is to provide a mat construction of simple design which does not require the use of sophisticated jigs during mass production.

A further object of this invention is to provide a mat construction which may be of one piece, molded construction.

A still further object of this invention is to provide a mat construction which will require minimum cleaning after each usage upon soft ground.

Yet another object of this invention is to provide a mat construction which may be molded primarily of wood products and resin.

Another object of this invention is to provide a platform mat construction of substantially eight feet in width and which may be made double wide to provide for a single lane roadway with the usual less than eight foot spacing between the wheels of vehicles serving to minimize downward depression of the outer margins of the roadway beneath soft ground over which the roadway is formed.

Yet another object of this invention is to provide a mat construction which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
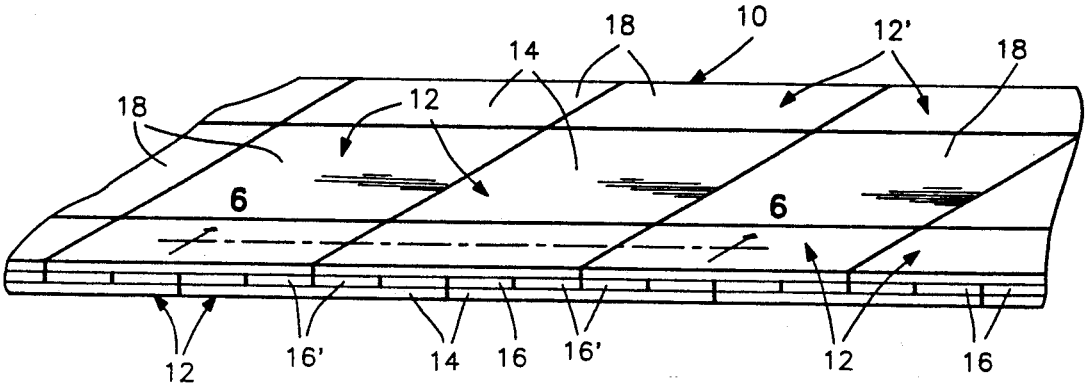
FIG. 1 is fragmentary perspective view of a double wide roadway constructed through the utilization of a plurality of right side up and inverted mat constructions of the instant invention and wherein the rectangular planar surface defining member of each mat construction is formed by a single unbroken panel member.

Referring now more specifically to the drawings the numeral 10 generally designates a roadway which has been constructed over soft ground utilizing a plurality of mat constructions, or structures, of the instant invention.

Each mat structure is referred to in general by the reference numeral 12 or 12' and includes a rectangular substantially planar surface defining member 14 or 14' and a pair of opposite end elongated transverse members 16 or 16'.

Each rectangular surface defining member 14 defines a first rectangular surface 18 and a second rectangular surface 20 facing opposite, or underside, and paralleling the first surface 18. In addition, each transverse member 16 (sometimes referred to as a transverse end member) is secured to the opposite ends of the rectangular surface defining member 14 in any convenient manner, such as by nails, glue, etc.

The mat constructions 12' are identical to the mat constructions 12, except that the mat constructions 12' are one-half the width of the mat constructions 12. The mat constructions 12 and 12' utilize one piece rectangular surface defining members 14 and 14' and one piece transverse logs or members 16 and 16'.

When the mat constructions 12 and 12' have their first rectangular surfaces 18 and 18' disposed uppermost, the transverse logs or end members 16 and 16' are secured to the undersides of the rectangular surface defining members 14 and 14'. When constructing the roadway 10, some mat structures 12 and also the mat structures 12' are disposed with their first rectangular surfaces 18 disposed uppermost and other mat structures 12 are disposed with their first rectangular surfaces 18 disposed lowermost to lie on the ground.

Figure 6:
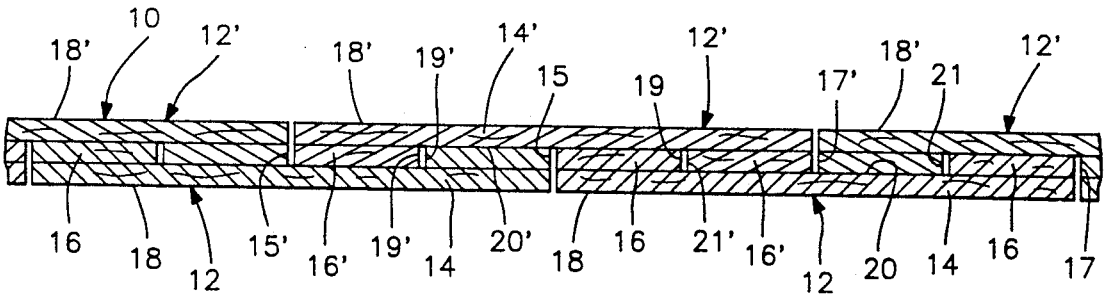
FIG. 6 an enlarged fragmentary vertical sectional view taken substantially upon the plane indicated by the section line 6—6 of FIG. 1.

The transverse members or panels 16, 16' define edge surfaces that extend substantially perpendicular from the underside of the planar surfaces 14, 14'. As shown in FIG. 6, a first edge surface 15, 15' is substantially flush with one end of the mat structure 12, 12'. A second edge surface 17, 17' is substantially flush with the opposite end of the mat structure 12, 12'. A third edge surface 19, 19' is located at a distance no greater than, and approximately, one-quarter the overall length of the mat structure from the first edge surface 15, 15'. A fourth edge surface 21, 21' is located at a distance no greater than, and approximately, one-quarter the overall length of the mat structure from the second edge surface 17, 17'. Similar edge surfaces 115', 117', 119', and 121' are shown in the FIG. 2 embodiment, wherein each transverse member, or panel, is formed from two logs or planks 116 spaced closely together, in a manner to be described.

The overall length of the transverse logs or members 16 and 16', i.e. from the edge surface flush with the end of the mat to the innermost edge surface, is slightly less than one-quarter the length of the rectangular surface defining member 14 and 14'. As a result, the spacing between the transverse logs or members 16 and 16' of each mat structure 12 and 12' is slightly greater than one-half the length of the corresponding rectangular surface defining member 14 and 14'. That is, the distance between the edge surfaces 19 and 21 (or 19' and 21', or 119' and 121') is slightly greater than one-half the distance between the edge surfaces 15 and 17 (or 15' and 17', or 115' and 117'). In this manner, when constructing the roadway 10, a double row of mat structures 12 are disposed lengthwise in end-to-end aligned and abutted relation with their second rectangular surfaces 20 and their transverse logs or members 16 disposed uppermost, see FIG. 6. Thereafter, a first row of mat structures 12' with their first rectangular surfaces 18' disposed uppermost and their transverse logs or members 16' disposed lowermost are centered over the first laid two rows of mat structures 12 in end-to-end aligned and abutting relation with the adjacent transverse logs or members of end abutted upper mat sections 12' received between the transverse logs or members 16 of the lower mats 12 and the transverse logs or members 16 of abutted ends of lower mats 12 received in the spacing between the transverse logs or members 16' of the upper mat structures 12'. Two rows of one-half width mat constructions 12' may be disposed over the exposed remote side half marginal portions of the first laid two rows of mat constructions 12 with the half width mat constructions 12' aligned transversely of the roadway 10 with the corresponding upper mat structures. In this manner, the upper and lower mat structures 12 and 12' are relatively tightly interlocked or interconnected together against relative longitudinal shifting and the friction between the upper and lower mat structures 12 and 12' strongly resists relative lateral shifting between upper and lower mat sections 12 and 12'. Further, when a vehicle with slightly less than eight foot spacing between opposite side wheels is driven down the center of the roadway 10 on the center row of upper mat structures 12, the weight of the vehicle is supported more from the adjacent margins of the underlying bottom mat structures 12 and, thus, there is little tendency for soft mud at the longitudinal margins of the roadway 10 to bulge up and overflow the roadway longitudinal margins.

The mat sections 12 and 12' may be constructed entirely of wood with the transverse logs or members 16 and 16' comprising large transverse planks or panels and with the rectangular surface defining members comprising heavy plywood panel sections, both the rectangular surface defining members 14 and 14' and the transverse log or members 16 and 16' being treated against rot.

The overall dimensions of the mat structure can vary. One preferred dimension is that width of the mat structure be approximately 8 feet and the length either 12 feet or 8 feet. The length and width dimension is substantially greater than the thickness dimension, as is apparent from the drawings.

Figure 2:
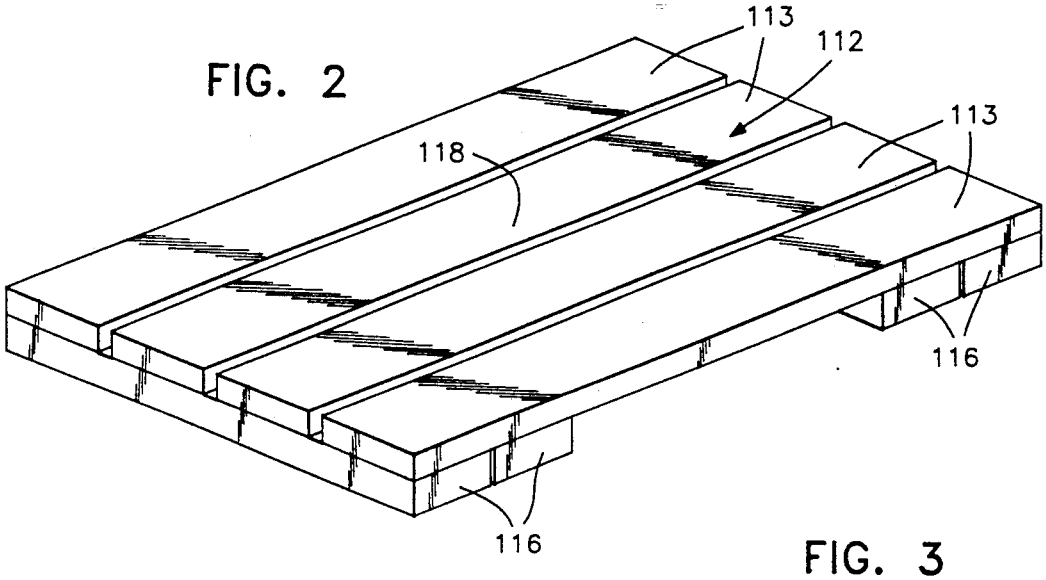
FIG. 2 is a perspective view of a modified form of mat construction wherein the rectangular planar surface defining member is constructed of four plank-type members and wherein each transverse member at the opposite ends of rectangular surface defining member is formed of a pair of closely spaced transverse planks or boards.
Figure 3:
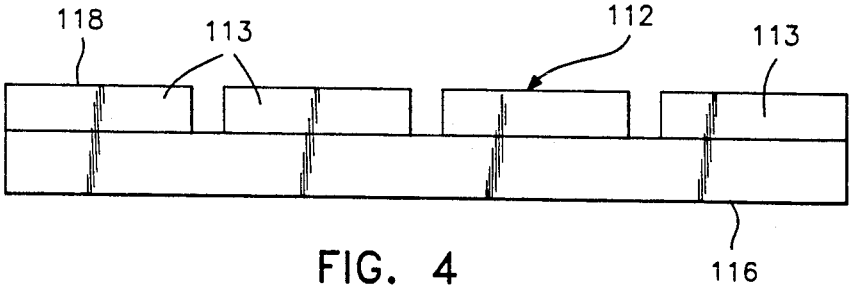
FIG. 3 is an enlarged end elevational view of the mat construction illustrated in FIG. 2.

With attention now invited more specifically to FIG. 2 of the drawings, there may be seen a modified form of mat structure 112 which utilizes plural individual plank sections 113 as the rectangular surface defining member thereof and a pair of plank members 116 defining each of the transverse end logs or end members thereof. Although four planks are depicted to define the planar surface, it should be apparent that more or less planks may be utilized depending on the desired width of the mat. Similarly, although two planks 116 are depicted to define each transverse log or end member, more than two planks may be utilized. The significant design criterion is the distance between edge surfaces 115' and 119' (and 117' and 121') so that this distance is less than, but approximately equal to, one-quarter the length of the mat. The space between edge surfaces 119' and 121' is open, i.e. free of any edge surfaces and equal to at least approximately one-half the length of the mat.

The plank members 113 are slightly spaced apart to allow heavily laden rubber tire areas aligned with the spacing between adjacent plank members 113 to be depressed downwardly between adjacent planks 113 in order to increase traction between the tires of wheeled vehicles and the first rectangular surface 118 of the mat structure 112. Here again, the plank members 113 and 116 may be constructed of wood or even molded of wood products mixed with resin. Of course, the mat structure 112 also may be constructed as a one-half mat structure and used in the same manner as the mat structure 12'.

Figure 4:
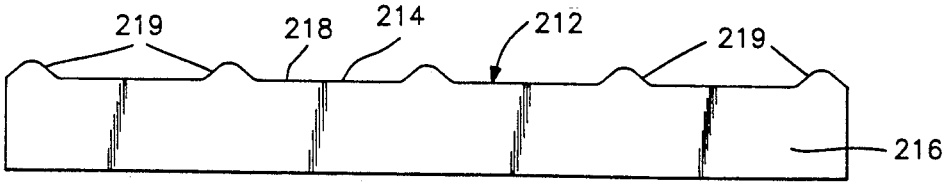
FIG. 4 is an end elevational view of a one piece mat construction wherein the rectangular planar surface defining member and the transverse members are integrally formed by, for example, a molding process.
Figure 5:
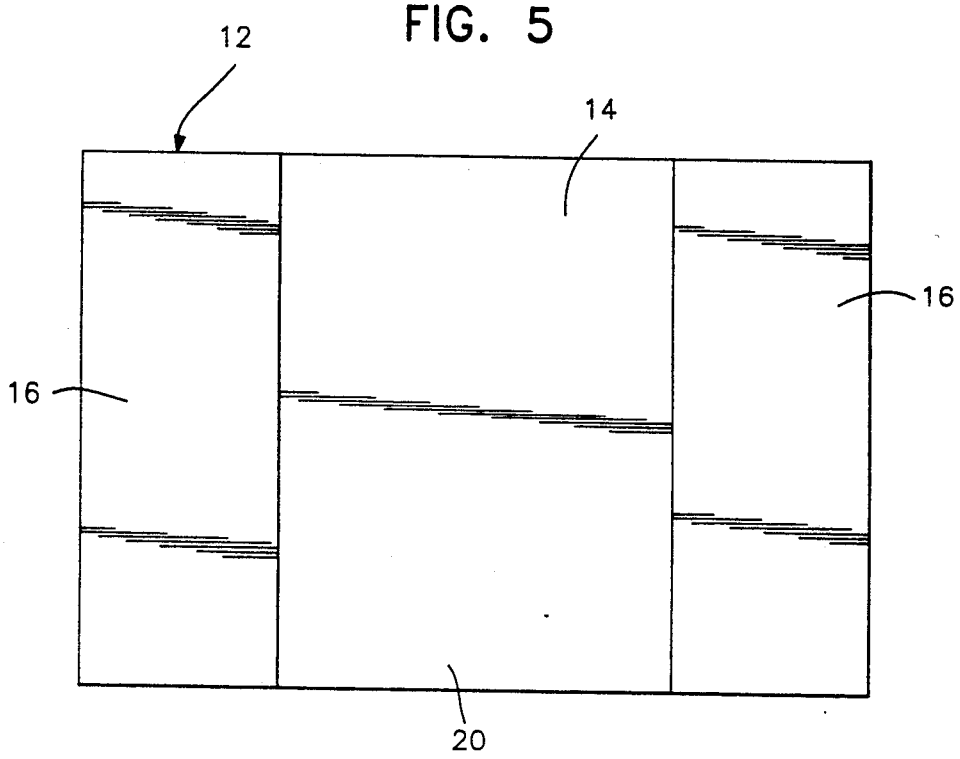
FIG. 5 is a reduced bottom plan view of a mat construction of the type illustrated in FIG. 1.
Figure 7:
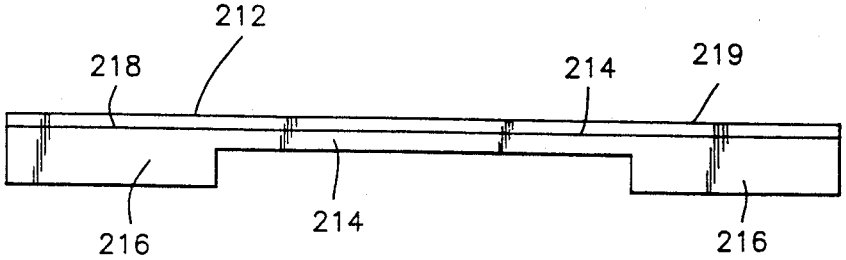
FIG. 7 is a reduced side elevational view of the one piece mat construction in FIG. 4.

Referring now more specifically to FIGS. 4 and 7, the reference numeral 212 refers to a third form of mat structure which is of one piece construction and constructed of a mixture of wood chips and resin, or the like. The first rectangular surface 218 of the mat structure 212 is substantially planar and includes four integral longitudinally extending, transversely spaced and generally inverted V-shaped ridges 219 for increasing traction between a wheeled vehicle and the first rectangular surface 218. Of course, these ridges are optional. The transverse logs or members 216 or formed integrally with the rectangular surface defining member 214 of the mat structure 212. The ridges 219, in addition to affording increased traction between the first rectangular surface 218 and wheeled vehicles moving thereover, also provide longitudinal stiffening for the mat structure 212. Also, as before, the mat structure 212 may be constructed as a one-half width mat structure.

It has been found that utilizing only two transverse members or panels at the opposite ends of each mat section 12 or 12' results in simplified construction of the mat sections 12 and 12', as opposed to mat sections previously known which incorporate more than two transverse log members or planks and which are interdigitated with relatively inverted mat sections of the same type. Previous mat sections utilizing more than two members must be constructed through the utilization of jigs to insure proper spacing between the transverse log members and they are more difficult to clean after usage on soft ground to insure that the interdigitation of the log members of relatively inverted mat sections subsequently may be accomplished.

With applicant's invention it is only necessary to provide the rectangular surface defining members 14 and 14' and transverse logs or members 16 and 16' of the correct dimensions. Then, the transverse logs or members 16 and 16' may be readily secured to the opposite ends of the rectangular surface defining members 14 and 14', inasmuch as the transverse logs or members are substantially aligned with the end edges of the rectangular surface defining members 14 and 14' and the opposite side longitudinal margins of the rectangular surface defining members 14 and 14'. This type of construction enables the mat structures 12 and 12' to be assembled by persons having minimum education and instruction while still providing a product which is superior in its ability to be quickly erected in order form a roadway such as the roadway 10 and also its ability to be readily cleaned for subsequent usage.

Figure 8:
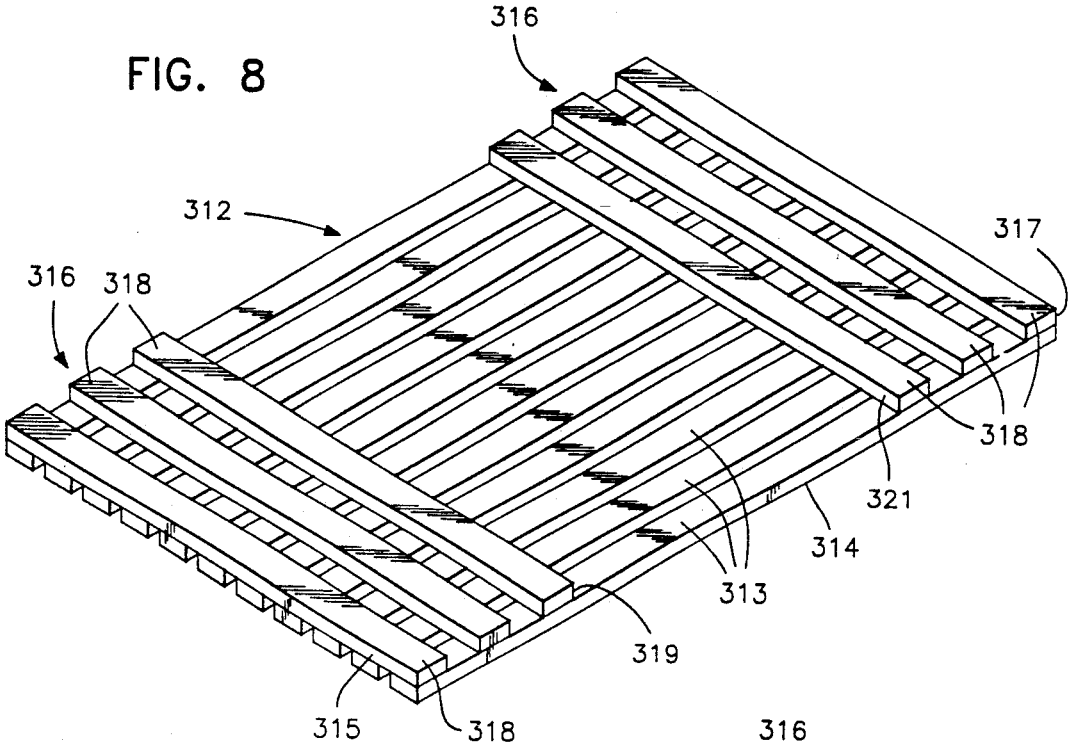
FIG. 8 a perspective view of another form of mat construction or structure wherein the rectangular planar surface defining member is constructed of a plurality of planks and wherein each of the transverse members is formed of three spaced-apart transverse planks, boards or logs.
Figure 9:
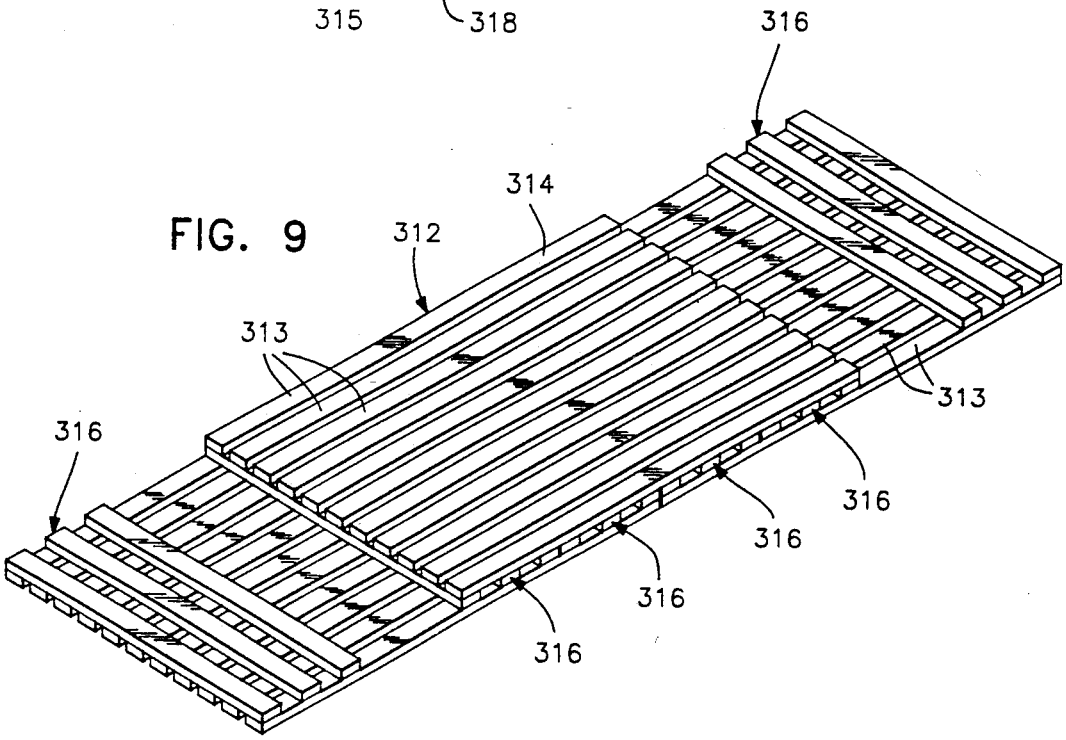
FIG. 9 is a perspective view of a portion of a temporary roadway formed from a plurality of mat structures of the type shown in FIG. 8.

Another embodiment of the present invention is shown in FIGS. 8 and 9. FIG. 8 shows an inverted mat structure 312 having a substantially planar surface defining member 314 formed of a plurality of planks 313 arranged in a lengthwise direction similar to that of the FIG. 2 embodiment. Extending from the underside of the planar surface member 314 along the width dimension, are a pair of transverse structures, beams or end members 316. Each of the transverse structures or members 316 are formed from a plurality of planks, specifically three planks 318, that are spaced apart from each other in the lengthwise direction of the mat. That is, the three planks 318 form a single transverse structure beam or end member 316 that collectively provide the same function as the transverse members 16, 116, 216 of the earlier-described embodiments. The transverse structures 316 define edge surfaces 315, 317, 319 and 321 that extend substantially perpendicularly from the planar surface member 314. As with the above described embodiments, the distance lengthwise from the first edge surface 315 to the third edge surface 319 is slightly less than one-quarter the length of the mat structure 312 from the edge 315 to the edge 317. The distance between the edge surface 317 to edge surface 321 is also slightly less than one-quarter the length of the mat structure 312. The space between the edge surfaces 319 and 321 is thus slightly greater than one-half the length of the mat structure and is open or free of any additional edge surfaces, or planks, or other protrusions. As is shown in FIG. 9, a roadway is formed such that the transverse end members 316 of adjacent mat structures (part of a set of mat structures) disposed on the ground abut with each other and fit relatively freely yet snugly, within the space between the pair of transverse end members, beams or panels, of a single mat structure disposed on top of the bottommost set. The topmost mat structures similarly define a set of mat structures arranged lengthwise in end-to-end relationship, although for purposes of illustration, only a single topmost mat structure is shown.

The primary advantage of utilizing spaced-apart beams or planks 318, instead of a single solid member or panel 16 or a pair of closely spaced end members or beams 116, as shown in FIGS. 1 and 2, respectively, is for weight savings. Because the significant design criterion requires only two edge surfaces 315, 319 or 317, 321 at opposite ends of the mat structure, the construction lying between the edge surfaces 315, 319 is not critical. For example, instead of three beams or planks 318, only two beams can be used with spacing therebetween. It has been found, however, that by using at least three spaced-apart beams, the central beam provides structural rigidity and minimizes potential bending, and possible breakage, of the upper planar surface.

It should also be realized that the transverse end members, beams or panels 316 formed of spaced apart beams 318 can also be utilized with a planar surface that is a solid rectangular panel, such as plywood, instead of parallel beams 313. Similarly, the entire construction can be formed as a molded unit or a one-piece unit formed of wood chips or wood products mixed with a suitable resin.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is as follows:

1. A board mat construction for soft ground, said mat construction including a plurality of rectangular, panel-like first and second mat structures, said mat structures each including opposite transverse end margins and opposite side longitudinal margins and defining a first rectangular surface, a second rectangular surface facing opposite and paralleling said first surface, said second surface including a pair of opposite end portion elongated log structures disposed transverse to the corresponding mat structure having remote longitudinal sides generally flush with said end portions and opposite ends generally flush with said longitudinal margins, the area of said second surface between each pair of log structures being substantially rectangular and of a length, taken longitudinally of said mat, substantially equal to one-half the length of said mat, the width of each of said log structures being substantially equal to one-fourth the length of said mat, the surfaces of said log structures facing in the direction of said second surface being generally co-planar and spaced a predetermined distance outward of said second surface, said first mat structures being arranged in a first row of end abutted and aligned first mat structures with said first surfaces thereof facing upwardly, said second mat structures being arranged in a second row of end abutted and aligned second mat structures with said second mat structures disposed in one-half lengthwise staggered relation relative to said first mat structures and with said first surfaces of said second mat structures facing downwardly and the end log structures of adjacent ends of said second mat structures snugly received upwardly into the spacing of the first mat structure disposed thereabove between the end log structures thereof and the end log structures of adjacent ends of said first mat structures being snugly received downwardly into the spacing of the second mat structure disposed therebelow between the end log structures thereof.

2. The board mat construction of claim 1 wherein said first and second surfaces of said mat structures are defined by upper and lower surfaces of side-by-side plank members extending longitudinally of said mat structures and said log structures of each mat structure are formed separately from and anchored to the corresponding ends of said plank members.

3. The board mat construction of claim 2 wherein each of said log structures comprise multiple side-by-side log members each anchored to the corresponding plank member ends.

4. The board mat construction of claim 2 wherein each of said log structures comprises a single panel member anchored to the corresponding plank member ends.

5. The board mat construction of claim 1 wherein said first and second surfaces of said mat structures are defined by upper and lower surfaces of a single panel member structure spanning across the corresponding log structures.

6. The board mat construction of claim 5 wherein each of said log structures comprise a single log member anchored to the corresponding plank member ends.

7. The board mat construction of claim 5 wherein said log structures are integrally formed with the corresponding panel member structure.

8. The board mat construction of claim 5 wherein said upper surface of said single panel member structure includes a plurality of integral upwardly projecting, transversely spaced, and longitudinally extending reinforcing and traction increasing ribs.

9. The board mat construction of claim 8 wherein said log structures are integrally formed with the corresponding panel member structure.

10. The board mat construction of claim 1 wherein said mat structures are substantially eight feet in transverse width and between eight and twelve feet in length.

11. The board mat construction of claim 1 including additional mat structures corresponding to said first and second mat structures, but of a width substantially only one-half the width of said first and second mat structures, a third row of said first mat structures disposed closely alongside and paralleling said first row of mat structures and transversely aligned therewith, said second row of said second mat structures being centered, laterally, over said first and second rows, and two additional rows of said one-half width additional mat structures disposed over the remote half width portions of said first and third rows with the additional mat structures of said additional rows transversely aligned with the second mat structures of said second row.

12. A roadway formed from a plurality of mat structures, each mat structure being rectangular in shape and having a length and width dimension substantially greater than its thickness dimension, each said mat structure having a substantially planar first surface and a plurality of transverse edge surfaces extending from the underside of said first surface and across the width dimension of the mat structure, said plurality of edge surfaces including a first edge surface substantially flush with one end of the mat structure, a second edge surface substantially flush with the opposite end of the mat structure, a third edge surface located at a distance approximately one-quarter the length of the mat structure away from the first edge surface, and a fourth edge surface located at a distance approximately one-quarter the length of the mat structure away from the second edge surface, wherein the space between the third and fourth edge surfaces is free of any edge surfaces, said mat structures arranged in two sets to form a roadway, the first set comprising a plurality of mat structures arranged in lengthwise end-to-end relationship with the substantially planar first surfaces facing toward the ground, the second set comprising a plurality of mat structures arranged lengthwise in end-to-end relationship with their substantially planar first surfaces facing upwardly to form the roadway surface, wherein the first and second sets interengage with each other such that adjacent mat structures of one of the first or second sets are coupled with a mat structure of the opposite set.

13. A roadway as claimed in claim 12 wherein each of the transverse edge surfaces extend across the entire width of the mat structure.

14. A roadway as claimed in claim 12 wherein each of said transverse edge surfaces are formed from beams connected with the underside of said substantially planar first surface.

15. A roadway as claimed in claim 14 wherein said first and third edge surfaces are formed from first and second beams connected with the underside of said substantially planar first surface and said second and fourth edge surfaces are formed from third and fourth beams connected with the underside of said substantially planar first surface .

16. A roadway as claimed in claim 15 wherein said first and second beams are substantially adjacent each other and said third and fourth beams are substantially adjacent each other.

17. A roadway as claimed in claim 15 wherein said first and second beams are positioned to define a space between them and said third and fourth beams are positioned to define a space between them.

18. A roadway as defined in claim 17 further comprising a fifth beam between the first and second beams and a sixth beam between the third and fourth beams.

19. A roadway as claimed in claim 14 wherein the beams are integral with the substantially planar first surface.

20. A roadway as claimed in claim 14 wherein the substantially planar first surface is formed from a plurality of beams extending in a direction along the length dimensions of the mat structure.

21. A roadway formed form a plurality of mat structures, each mat structure being rectangular in shape and having a length and width dimension substantially greater than its thickness dimension, each said mat structure having a substantially planar surface and a pair of transverse members extending from the underside of said planar surface, sad transverse members defining oppositely facing end edges substantially flush with opposite ends of said mat structure and opposing intermediate edges spaced between said end edges, wherein the space between the intermediate edges is open and the distance between the intermediate edges is slightly greater than one-half the overall length of the mat structure, wherein the mat structures are intercoupled to form a roadway having the planar surface facing in opposite directions with the adjacent transverse members of substantially end abutted mat structures received between the intermediate edges of a relatively inverted mat structure.

22. A roadway as claimed in claim 21 wherein each transverse member is formed from a plurality of beams substantially parallel to each other and extending across the width direction of the mat structure.

23. A roadway as claimed in claim 22 wherein said plurality of beams are spaced from each other in a direction along the length of the mat structure.

24. A roadway as claimed in claim 21 wherein the substantially planar surface is formed from a plurality of beams extending in a lengthwise direction.

* * * * *